US005087861A

United States Patent [19]

Boyd et al.

[11] Patent Number: 5,087,861

[45] Date of Patent: Feb. 11, 1992

[54] DISCHARGE LAMP LIFE AND LAMP LUMEN LIFE-EXTENDER MODULE, CIRCUITRY, AND METHODOLOGY

[75] Inventors: Dudley G. Boyd, El Toro; Edward G. Price, Costa Mesa; Valiant G. Kanaga, Huntington Beach; Nian Chen, Costa Mesa, all of Calif.

[73] Assignee: Deltove Limited, Toronto, Canada

[21] Appl. No.: 402,484

[22] Filed: Sep. 1, 1989

[51] Int. Cl.[5] ..... H05B 41/16

[52] U.S. Cl. ..... 315/247; 315/291; 315/DIG. 7

[58] Field of Search ..... 315/DIG. 7, DIG. 5, 315/247, 291, 307

[56] References Cited

U.S. PATENT DOCUMENTS

| | | | |
|---|---|---|---|
| 3,780,347 | 12/1973 | Riesland | 315/247 |
| 3,996,495 | 12/1976 | Herman | 315/DIG. 5 |
| 4,496,880 | 1/1985 | Lück | 315/247 |
| 4,523,795 | 6/1985 | Johnson | 315/244 |
| 4,527,099 | 7/1985 | Capewell | 315/291 |
| 4,698,554 | 10/1987 | Stupp | 315/307 |
| 4,717,863 | 1/1988 | Zeiler | 315/307 |
| 4,723,098 | 2/1988 | Grubbs | 315/291 |
| 4,862,040 | 8/1989 | Nilssen | 315/282 |
| 4,902,958 | 2/1990 | Cook | 315/291 |
| 4,926,097 | 5/1990 | Taek | 315/307 |

*Primary Examiner*—Eugene R. LaRoche
*Assistant Examiner*—Amir Zarabian
*Attorney, Agent, or Firm*—Gordon L. Peterson

[57] ABSTRACT

A method of extending discharge lamp life includes slowing electrode deterioration by powering the discharge lamp so that a lamp arc current having a reduced crest factor results, either by retrofitting an existing discharge lamp system with a waveform conditioning module, by powering the discharge lamp with a ballast producing a squarewave-type waveform, or by slowing deterioration of an emissive coating on a discharge lamp electrode by such means as preheating the electrode prior to use in order to bond the emissive coating on the electrode. A discharge lamp system includes a discharge lamp and components operatively coupled to the discharge lamp for supplying a lamp arc current to the discharge lamp that has a reduced crest factor and controlled lamp watt loading, such as a ballast configured to supply a lamp arc current with a waveform that is substantially a squarewave or an existing ballast retrofitted with waveform conditioning circuitry that causes the lamp arc current to have a reduced crest factor. A module is provided for retrofit purposes in order to tune an existing ballast and discharge lamp so that the crest factor is reduced.

11 Claims, 4 Drawing Sheets

DISCHARGE LAMP LIFE AND LAMP LUMEN LIFE-EXTENDER MODULE, CIRCUITRY, AND METHODOLOGY

BACKGROUND OF THE INVENTION

1. Technical Field

This invention relates generally to discharge lamps, and more particularly to a module, circuitry, and methodology for extending discharge lamp life.

2. Background Information

A discharge lamp uses the technique of discharging electric current through mercury vapor and other gases to produce visible and ultraviolet radiation. As that happens in the case of fluorescent lamps, the ultraviolet radiation impinges upon a fluorescent coating on the lamp, causing the fluorescent coating to emit visible light that we can use for illumination purposes with notable efficiency. Thus, discharge lamps have come into widespread use so that the details of their construction and use demand attention.

Consider a fluorescent lamp for example. It includes a glass tube that the manufacturer coats with a fluorescent material, fills with mercury vapor, and supplies with an electrode at each end. We install the fluorescent lamp by plugging it into a lamp fixture designed to support the glass tube and supply electric current to the electrodes, the combination of the fluorescent lamp and lamp fixture sometimes being called a discharge lamp system.

The lamp fixture includes an electrical component called a ballast. The ballast transforms an external source of alternating current (such as 110-volt commercial or household current) to the voltage level necessary to operate the fluorescent lamp (i.e., high starting voltages, current-limited lower operating voltages, and any heater voltages required).

Two-terminal electrodes are used in what are called rapid-start type and pre-heat type discharge lamps (each electrode including a heater filament) and one-terminal electrodes are used in what are called instant-start discharge lamps (the electrodes being heated by the current flowing between them). Regardless of the type, we activate the ballast when we turn on the discharge lamp system and that causes an electric potential or voltage to be impressed across the lamp. An electric current (i.e., the lamp arc current) results that arcs between the electrodes, the electrons bombarding the mercury vapor thereby producing the ultraviolet radiation.

More specifically, the ballast impresses an alternating voltage across the electrodes so that each electrode acts as a cathode during one half-cycle and as an anode during the other half-cycle. Thus, the lamp arc current alternates in direction as it flows between the two electrodes. But the electrical characteristics of the ballast and fluorescent lamps are such that a highly distorted lamp arc current waveform results.

The ballast and fluorescent lamps are usually matched so that the fluorescent lamps operate at a prescribed efficiency and operational life expectancy, resulting in a highly distorted lamp arc current waveform that maintains lamp ignition and prescribed lamp brightness as well as having a direct effect on lamp lumen life and lamp mortality. The waveform may, for example, increase somewhat slowly to a peak and then rapidly decay to zero so that the ratio of the peak value to the RMS value (i.e., the lamp arc current crest factor) is about 1.7.

But the action of the lamp arc current slowly deteriorates the electrodes by depletion of the barium or other emissive electrode coating employed. We sometimes say that it causes the emissive coating to burn off, and such deterioration is affected by the lamp arc current crest factor.

In that regard, the electrodes are typically impregnated with rare earth oxides and other emissive elements that have an abundance of free electrons and low work functions. When the lamp is first installed and turned on, the electrodes heat up to operating temperature and that heats the emissive coating and causes more electrons to be emitted to facilitate the Townsend avalanche and also bond the emissive material in place which typically occurs within one hundred hours of lamp operation. However, until that process is completed, the emissive coating is even more vulnerable to the action of the lamp arc current. In other words, it can blow off or burn off all the more rapidly and deteriorate lumen and lamp life.

After the electrodes have deteriorated sufficiently and the bare tungsten electrode is exposed, the fluorescent lamp is no longer useable and must be replaced. This can result in costly maintenance in large commercial installations and it is aggravated by the less frequent but regular failure of aging ballasts. Some users even replace all lamps and ballasts periodically rather than wait for the lamps and ballasts to fail. Thus, lamp maintenance can be very expensive and time consuming so that we need some way of extending discharge lamp life.

SUMMARY OF THE INVENTION

This invention extends discharge lamp life and lamp lumen life by slowing electrode deterioration. That is done according to one aspect of the invention by producing a reduced crest factor that is less than that of existing systems (i.e., less than about 1.7), either with a waveform conditioning module that is retrofitted to an existing ballast or with a ballast that produces a squarewave-type waveform, or electrode deterioration is slowed according to another aspect of the invention by slowing deterioration of the emissive coating on the electrode, such as by preheating the electrode before, during, or after fabrication so that the emissive elements are bonded more securely to the electrode before use. Those techniques result in discharge lamp life and lumen life increasing to two to three times normal, thereby greatly reducing the time, inconvenience, and cost of lamp maintenance.

In line with the foregoing, a discharge lamp system constructed according to the invention includes a discharge lamp and means operatively coupled to the discharge lamp for supplying a lamp arc current to the discharge lamp that has a reduced crest factor. In addition to other benefits, that results in a reduced product of the in-phase voltage and current dissipated in the lamp system. According to one aspect of the invention, the means operatively coupled to the discharge lamp includes a ballast configured to supply a lamp arc current to the discharge lamp so that the lamp arc current has a waveform that is substantially a squarewave. According to another aspect, the means operatively coupled to the discharge lamp includes a ballast configured to supply lamp arc current to the discharge lamp so that the lamp arc current has a crest factor of a predetermined value (a conventional ANSI value) and waveform conditioning means operatively coupled to the ballast for causing the lamp arc current to have a crest factor less than the predetermined value.

The waveform conditioning means may include a module configured to be retrofitted to an existing ballast, and the module may employ components that combine with the ballast and discharge lamp to form a tuned circuit that results in a reduced crest factor. In addition, the module may be adapted for use with the ballast in a particular one of various types of systems, such as a rapid-start type of discharge lamp system, an instant-start type of discharge lamp system, a pre-heat type of discharge lamp system, and/or a high intensity discharge lamp system.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
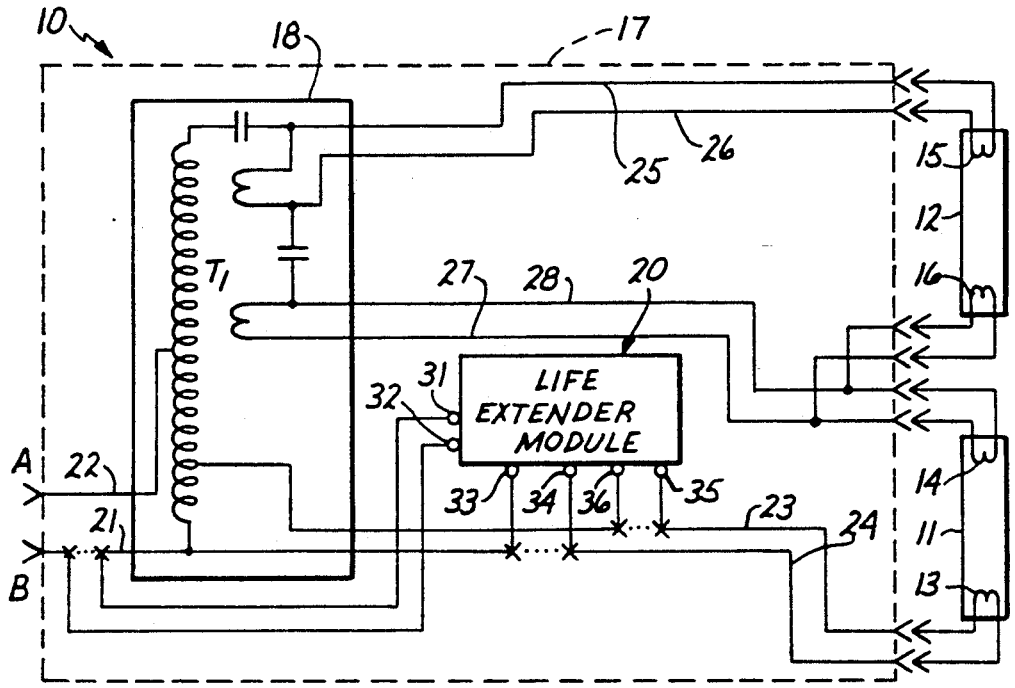
FIG. 1 of the drawings is a diagrammatic representation of a rapid-start type of discharge lamp system constructed according to the invention.

Referring now to FIG. 1, there is shown a discharge lamp system 10 constructed according to the invention. Generally, the system 10 includes one or more discharge lamps (such as the lamps 11 and 12) and means operatively coupled to the discharge lamps for supplying a lamp arc current to the discharge lamps that has a reduced crest factor. In other words, the system 10 includes means for slowing electrode deterioration by powering the discharge lamps so that a lamp arc current having a reduced crest factor results.

The crest factor can be reduced in several ways as subsequently described. But, first consider the lamps 11 and 12 and the general manner in which they are supported and powered. Although any of various types of discharge lamps may be employed, the lamps 11 and 12 are conventional fluorescent lamps. The lamp 11 has two-terminal electrodes 13 and 14. Similarly, the lamp 12 has two-terminal electrodes 15 and 16, and the lamps 11 and 12 are plugged into a convention fluorescent lamp fixture 17 so the electrodes are connected to a conventional ballast 18 within the fixture 17.

Crest factor reduction is accomplished in the system 10 by retrofitting the lamps 11 and 12 and the ballast 18 with a waveform conditioning module 20. The module 20 includes circuitry mounted in a suitable manner, such as on a circuit board that is encapsulated or otherwise suitably housed, for example. The module 20 is placed in the fixture 17 where it is wired into the existing fixture circuitry as subsequently described to produce the system 10.

Before modification, the fixture 17 is wired to enable first and second input lines 21 and 22 to connect the ballast 18 in a known manner to an external source of any alternating current, such as 110-VAC source (not shown), via input terminals A and B. In addition, output lines 23 and 24 connect the ballast 18 to the electrode 13 of the lamp 11, output lines 25 and 26 connect the ballast 18 to the electrode 15 of the lamp 12, and output lines 27 and 28 connect the ballast 18 to the electrodes 14 and 16 of the lamps 11 and 12, all in a known way.

The module 20 is retrofitted to the fixture 17 by breaking either one of the first and second input lines 21 and 22 and connecting terminals 31 and 32 of the module 20 at the break in the line, FIG. 1 showing a break in the input line 21 for that purpose. In addition, the output lines 23 and 24 are broken where indicated and the terminals 33–36 of the module 20 are connected at those breaks, FIG. 1 utilizing "x . . . x" to illustrate each break. Once the module 20 has been connected in that manner, the system 10 operates with a reduced crest factor that substantially lengthens the life and lumen life of the discharge lamps 11 and 12.

Of course, the precise manner in which the module is connected to an existing discharge lamp system depends on the waveform conditioning circuitry employed in the module. In that regard, any of various circuits designed according to known techniques using known components may be used within the broader inventive concepts disclosed as long as the circuit operates in conjunction with the existing discharge lamp and ballast to reduce the lamp arc current crest factor. Examples of circuitry employed in modules suitable for use with rapid-start type, pre-heat type, and instant-start type discharge lamps are described subsequently.

Figure 2:
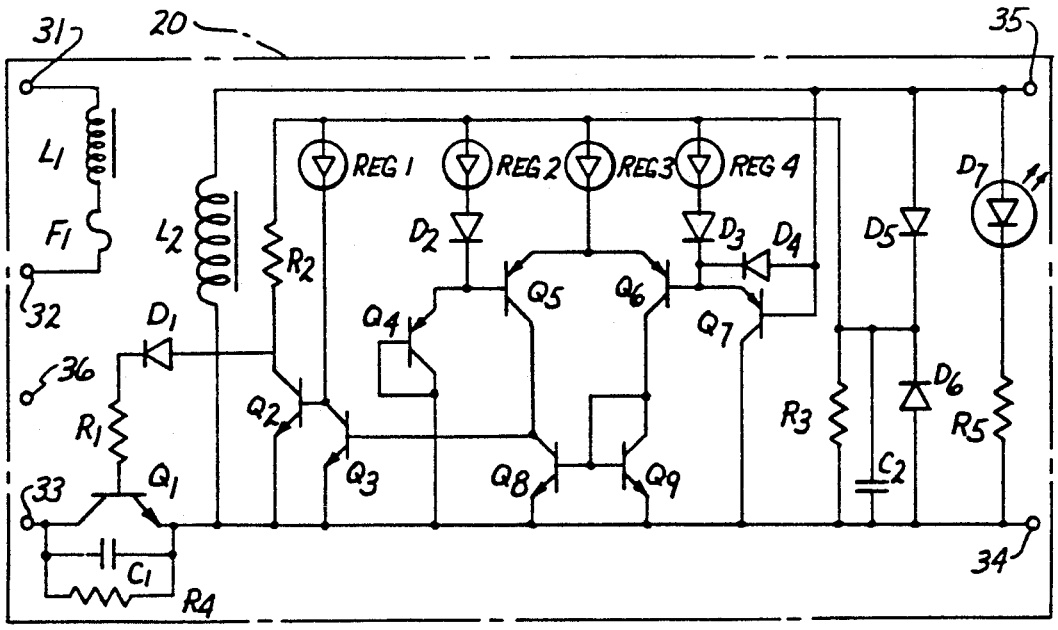
FIG. 2 is a schematic circuit diagram of the waveform conditioning circuitry employed in the rapid-start module.

Considering now FIG. 2, there is shown a schematic circuit diagram of the circuitry employed in the module 20 that operates with the ballast 18 and the lamps 11 and 12 in the rapid-start type discharge lamp system 10. Generally, the module 20 includes a tuned gyrator circuit having an inductor $L_1$ and fuse $F_1$ connected in series across the terminals 31 and 32. The inductor $L_1$ is mutually coupled to another inductor $L_2$, both the inductors $L_1$ and $L_2$ being any of various known inductive devices including ones synthesized artificially by transformation or other means. Typically $L_1$, by itself, improves the lamp arc current crest factor of most systems and therefore, is critical to any such circuit, and the values of $L_1$ and $L_2$ are chosen according to known circuit design techniques to operate with a semi-conductor switch, a diode, or a transistor $Q_1$ and a capacitor $C_1$ in a circuit that includes transistors Q2–Q9 diodes $D_1$–$D_4$, resistors $R_1$ and $R_2$, and current regulators Rg1–Rg4 as subsequently described.

Operating power is supplied to the circuit by means of a diode bridge that includes diodes $D_5$ and $D_6$, filter capacitor $C_2$ and discharge resistor $R_3$. Voltage is supplied to that diode bridge by means of the inductor $L_2$ which is inductively coupled to the inductor $L_1$.

Level shifting within the gyrator network is achieved by use of a diode across capacitor $C_1$ or triggering transistor $Q_1$ (or any other type of switch) off and into full saturation in a time sequence and a duty cycle such that the time rate of change of current through the inductor $L_1$ and the time rate of change of voltage across the capacitor $C_1$ are harmonically related and also synchronized. Among other benefits, level shifting across capacitor $C_1$ is a method of reducing the electrical burden and extending the useful life of any capacitor in such a circuit by not requiring the capacitor to charge and discharge each half cycle. Regarding $Q_1$, it can be replaced along with its drive circuitry, within the broader inventive concepts disclosed, with a diode to produce level shifting with no variable control as is afforded with $Q_1$ and its associated circuitry.

Proper timing to obtain the saturation and fully open limits of $Q_1$ are accomplished by the other components. Transistors $Q_5$ and $Q_6$ form a differential amplifier pair, driven respectively by transistors $Q_4$ and $Q_7$. Between terminals 35 and 34 there appears an alternating current voltage sinusoidal waveform of approximately five volts peak. The base of the transistor $Q_7$ is referenced to the voltage on the terminal 35 and the base of the transistor $Q_4$ is clamped to the zero voltage reference level of the terminal 34. The diodes $D_5$ and $D_6$, the capacitor $C_2$, and the bleeder resistor $R_3$ convert the sinusoidal voltage which exists across the terminals 34 and 35 into a direct current potential of approximately five volts at the node where the diode $D_5$ and $D_6$ are connected together (referenced to the terminal 34).

When the voltage potential of the terminal 35 rises passing through zero referenced to the terminal 34, the transistor output pair $Q_8$ and $Q_9$ of the differential amplifier become offset. Then, the driver transistor $Q_3$ is triggered on into full saturation, thus clamping the base of the output load transistor $Q_2$ to zero potential and turning it off. At that time, the direct current potential at the node where the resistor $R_2$ and the diode $D_1$ are connected together rises to approximately $R_1/(R_1+R_2)\times V_{36}$ (where $V_{36}$ is the voltage referenced to terminal 34), thus providing sufficient bias current to turn the transistor $Q_1$ on into full saturation. When the potential of the terminal 35 again traverses through to its peak and back to zero, as it passes through zero, the differential comparing process reverses and the transistor $Q_1$ becomes open, and remains open until the voltage at the terminal 35 again passes through zero and proceeds to go positive with respect to the terminal 35.

Within the framework of the discharge lamp system 10, the sinusoidal potential across the terminals 34 and 35 provides continuous and appropriate heater voltage to the electrode 13 of the lamp 11 and, by means of the diodes $D_5$ and $D_6$, the capacitor $C_2$, and the resistor $R_3$, operating voltage for the level-shifter circuit comprising the transistors $Q_1$–$Q_9$. The light emitting diode $D_7$ is connected in series with the resistor $R_5$ across the terminals 34 and 35 to provide an indication when power is on and the circuit is operational. If the circuit fails, such as by the fuse $F_1$ blowing or the primary or secondary of the transformer $T_1$ shorting or opening, the diode $D_7$ goes out to facilitate troubleshooting.

Also within the framework of the discharge lamp system 10, the capacitor $C_1$ is a constituent part of the current waveform conditioning path to the discharge lamp 11. The net impedance counterpoising the effective negative resistance of the discharge lamp is a positive value of the type $A\pm jB$, wherein the reactance of the inductor $L_1$ is transformed as a complex conjugate across the discharge ballast transformer $T_1$ in the form $$Z = Z_{11} + \left|\frac{\omega M}{Z_{22}}\right|^2 [R_L - j(\omega L_2 + X_{Cl})]$$

Z is the impedance at the input to the overall discharge lamp network (across the input terminals A and B). $Z_{11}$ is the impedance of the inductor $L_1$, including its internal resistance, and the primary winding of the ballast transformer $T_1$. The Greek letter omega ($\omega$) is the radian frequency of the network. M is the mutual inductance of the discharge ballast transformer $T_1$. $M=kL_pL_s$, where k is the coupling coefficient. $Z_{22}$ is the impedance of the lamp secondary side of the transformer $T_1$, including the secondary winding, the lamp impedance $R_L$, and the reactance of the capacitor $C_1$. The form of $Z_{22}$ is $R_L+j(\omega L_s+X_{Cl})$. Thus, the impedance from the perspective of either side of the discharge ballast transformer $T_1$ is the complex conjugate of the other side, transformed by the level $$\left|\frac{\omega M}{Z_{22}}\right|^2$$

Therefore, the overall current-waveform conditioning path to the discharge lamp includes a gyrator network providing not only the desired predetermined positive resistance but also an appropriate reactance to properly tune for maximum efficiency the transfer of energy at the fundamental frequency to the discharge lamp, and also provide the optimum voltage and current waveforms at the lamp for best longevity.

With the incorporation of the interactive gyrator network, the discharge lamp life and lumen life is extended beyond what it would be if the discharge lamp were connected only to a ballast. This life extension is achieved by lamp arc current crest factor reduction brought about by precise tuning of the reactances in the gyrator, creating lamp arc current waveform conditioning such that the waveform has no sharp peak excursions which would cause electrode barium depletion and loss of other emissive coating. The gyrator network overall reacts to the current surge that would normally be associated with the highly inductive ballast transformer when the lamp fires on each half cycle of the alternating current.

Life extension is also accomplished by an improved starting cycle (for rapid start systems) that is achieved by providing through the gyrator network a controlled increase in electrode heater voltage during the starting process. Proper heating of the cathode is achieved before the ignition of the arc, thereby extending electrode life.

In addition, improved lumen life results from reduced watt-loading brought about again by controlling the voltage and arc current waveforms of the lamp to reduce sharp excursions that can result in non-elastic collisions at the phosphor surface (i.e., reduce the crest factor or ratio of the peak value to the rms value). Also, reduced beat frequency flicker is brought about by precise tuning of the reactive components to ensure symmetry of the light output waveform.

Moreover, system efficacy improves by improving the lamp power factor. Again, system tuning corrects any inherent lamp voltage arc current out-of-phase condition by the transformed impedance through the gyrator network. Efficacy is also increased as RFI/EMI is reduced by waveform filtering. Also by waveform filtering, voltage transient and surge protection for the lamp is obtained.

Figure 3:
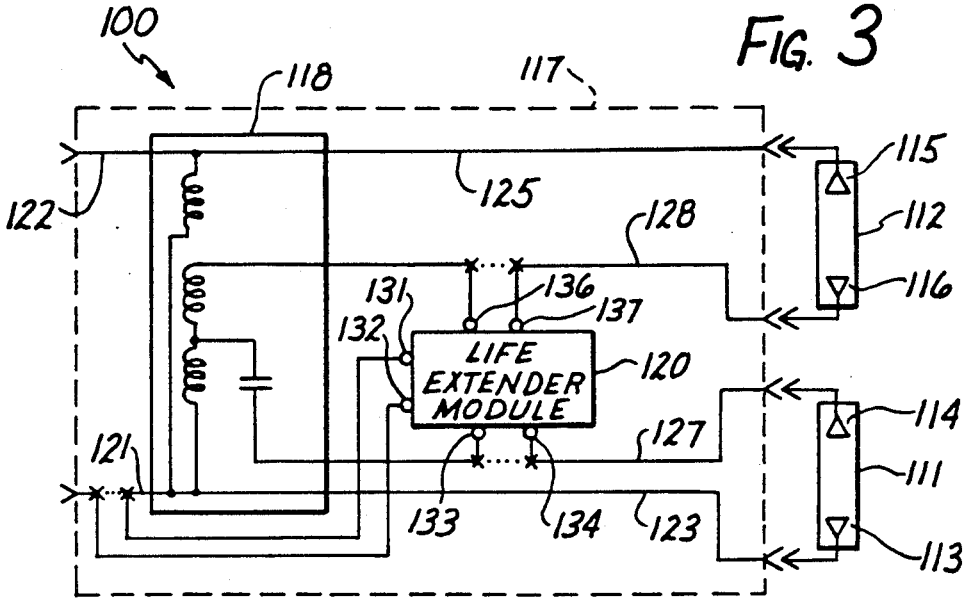
FIG. 3 is a diagrammatic representation of an instant-start type of discharge lamp system constructed according to the invention.
Figure 4:
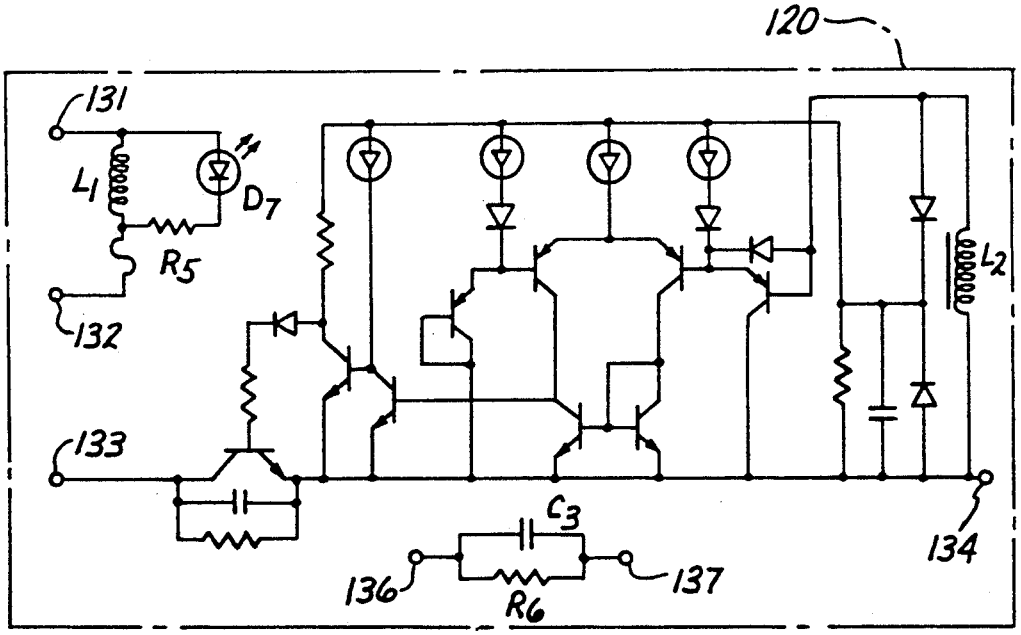
FIG. 4 is a schematic circuit diagram of the waveform conditioning module used in the instant-start type of discharge lamp system.

Considering now FIGS. 3 and 4, there is shown another discharge lamp system 100 constructed according to the invention, along with circuit details of a module 120 used in the system 100. The system 100 is similar in many respects to the system 10 so that only differences are described in further detail. For convenience, reference numerals designating parts of the system 100 are increased by one hundred over those designating similar parts of the system 10.

Commonly referred to as an instant-start type of discharge lamp system, the system 100 includes one or more discharge lamps of the known type having one-terminal electrodes, (i.e., a lamp 111 having one-terminal electrodes 113 and 114 and a lamp 112 having one-terminal electrodes 115 and 116). The lamps 111 and 112 are plugged into a known type of fixture 117 where they are powered by a known type of ballast 118 having input lines 121 and 122 for coupling to an external source of alternating current, and output lines 123, 125, 127, and 128 coupled to the lamps 111 and 112.

According to the invention, a module 120 is connected to one of the input lines 121 and 122, and to the output lines 127 and 128 of the ballast 118 by breaking the input lines where indicated by "x . . . x" and then connecting terminals 131-136 of the module 120 at the breaks as indicated in FIG. 1. That results in a reduced crest factor in a manner similar to that described above for the system 10. The circuitry utilized in the module 120 being quite similar to that employed in the module 20.

Unlike the module 20, the light emitting diode $D_7$ and resistor $R_5$ of the module 120 is connected across the inductor $L_1$. However, that arrangement functions in a similar way to the arrangement employed in the module 20. That is, if the current fails, such that the fuse $F_1$ opens, the diode $D_7$ also will go out which will facilitate troubleshooting. In addition, the module 120 includes a capacitor $C_3$ and a resistor $R_6$ that are not included in the module 20, they being connected in the output line 128 as part of the tuned gyrator circuit. Because the lamp 112 in the system 100 inherently maintains an impedance characteristic independent from the lamp 111, it is therefore necessary to fine tune the arc current waveform in connection with the tuned gyrator circuit for maximum improvement in the lamp arc current crest factor. That fine tuning is accomplished by the capacitor $C_3$ and the resistor $R_6$. Of course, the precise circuitry employed in the module 120 and the precise manner in which it is connected to the ballast 118 can vary within the broader inventive concepts disclosed while still reducing the lamp arc current crest factor for lamp lumen life and lamp life extension purposes.

Figure 5:
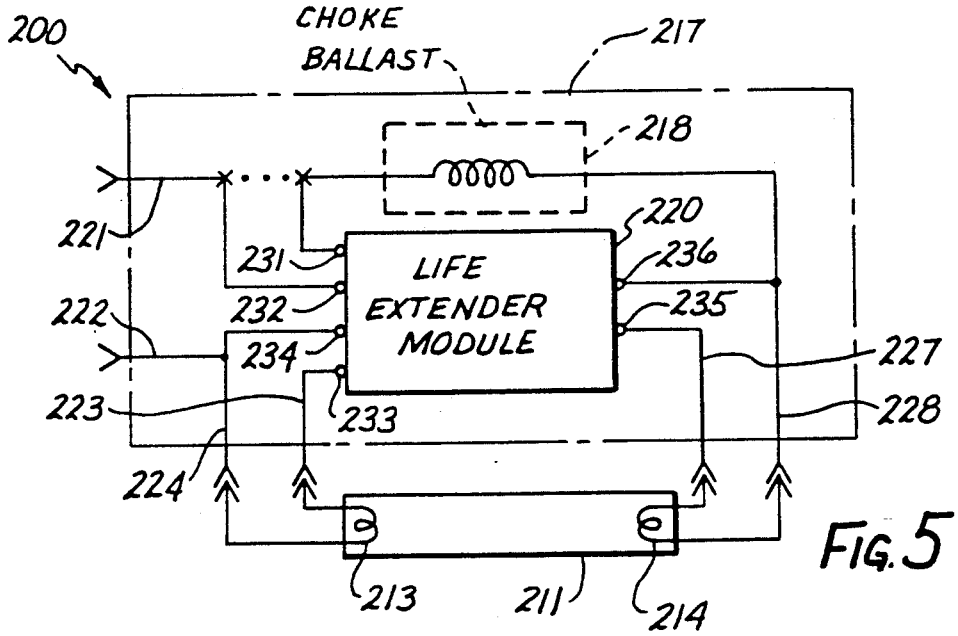
FIG. 5 is a diagrammatic representation of a pre-heat type of discharge lamp system constructed according to the invention.
Figure 6:
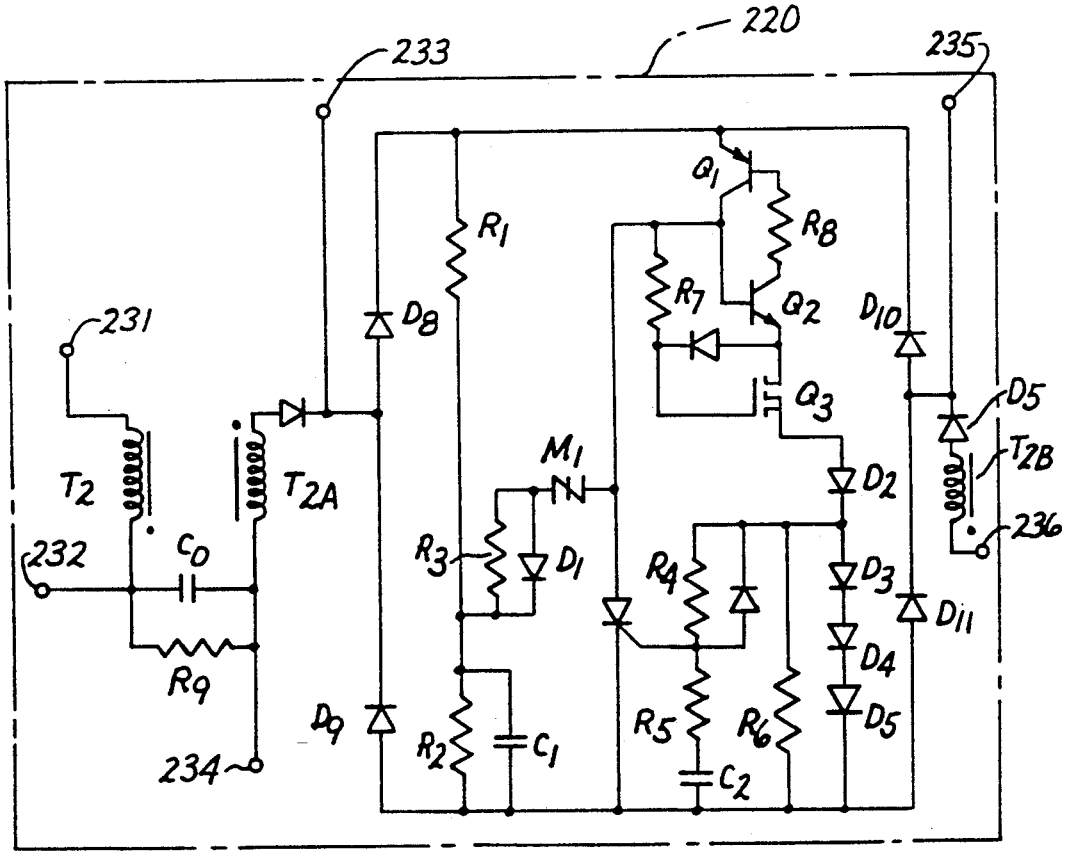
FIG. 6 is a schematic circuit diagram of the waveform conditioning module used in the pre-heat type of discharge lamp system.

Considering now FIGS. 5 and 6, there is shown yet another discharge lamp system 200 constructed according to the invention, along with circuit details of a module 220 used in the system 200. The system 200 is similar in many respects to the system 10 so that only differences are described in further detail. For convenience, reference numerals designating parts of the system 200 are increased by two hundred over those designating similar parts of the system 10.

Commonly referred to as a pre-heat type of discharge lamp system, the system 200 includes one or more discharge lamps of the known type having two-terminal electrodes, (i.e., a lamp 211 having two-terminal electrodes 213 and 214). The lamp 211 is plugged into a known type of fixture 217 where it is powered by a known type of ballast 118 having input lines 221 and 222 for coupling to an external source of alternating current, and output lines 233, 224, 235, and 228 coupled to the electrodes 213 and 214 of the lamp 111.

Those connections result in a capacitor $C_0$ in the module 220 being connected across the input lines 221 and 222 and the other circuitry in the module 220 being connected in the output lines as shown in FIG. 6. The circuitry of the module 220 utilizes known circuit design techniques and components to tune the combination of the ballast 218 and lamp 211 in the system 200 in order to improve lamp ignition and reduce the crest factor. Extended lumen life and lamp life results as explained above.

The circuitry includes a diode bridge arrangement of diodes $D_8$-$D_{11}$ maintaining a D.C. potential but of varying magnitude across lines 233 and 235. As an A.C. potential is applied to the input lines 221 and 222, initially an open circuit potential will result across terminals 213 and 214. concurrently, initially a static D.C. potential will exist across lines 233 and 235. That static-potential causes a current to flow through the resistor bridge $R_1$ and $R_2$, charging up the capacitor $C_1$ at the rate of $I=C(dv/dt)$ to a potential $V_1$. As the potential $V_1$ is reached and conditioned in form by the resistor $R_3$ and the diode $D_1$, the breakdown potential of the silicon bilateral voltage triggering switch $M_1$ is exceeded, thus causing it to saturate and thus provide a low impedance path for current to flow into the base of $Q_2$ and also apply a potential to the gate of $Q_3$.

With $Q_2$ activated ON, $Q_1$ is subsequently turned on, which further enhances the turn on of $Q_2$. The potential at the gate of FET $Q_3$ is such that $Q_3$ is actuated into an ON condition, then appearing in series with $Q_2$, and hence a low impedance path is generated between lines 233 and 235, limited by the saturation resistance of $Q_1$, $Q_2$, $Q_3$, and diodes $D_2$, $D_3$, $D_4$, and $D_5$.

At that time, a low potential across and a relatively high current through the terminals 233 and 235 occurs, thus causing a potential $V_2=L(di/dt)$ to appear across $T_2$ and the ballast, L consisting of the total inductance of $T_2$ and ballast 218.

As current passes through the diodes $D_3$, $D_4$, and $D_5$, a potential appears across the resistor $R_6$, and therefore across the resistor bridge $R_4$ and $R_5$ and the capacitor $C_2$. As the capacitor $C_2$ charges up in potential, SCR $Q_4$ is triggered ON, causing the gate potential of $Q_3$ to be below its trigger level, turning $Q_3$ OFF and thus forcing the potential at the base of $Q_2$ to be below that of its emitter, turning $Q_2$ and $Q_1$ OFF.

With $Q_1$, $Q_2$, and $Q_3$ turned OFF, very high D.C. potential $V_3$ appears across lines 233 and 235 due to the build up at the rate of $V_2=L(di/dt)$ across $T_2$ and the ballast. That potential $V_2$ is sufficient to cause ignition of the lamps 211, thus causing the potential difference between cathodes 213 and 214 to drop to the operating or running potential of the lamp, and also below the breakdown triggering level of the switch $M_1$. Thus, the potential between lines 233 and 235 remains in the open condition as long as the lamp 211 operates in the run mode. Should lamp 211 not ignite, the above process will be repeated.

Primary winding $T_2$ is mutually coupled to secondary windings $T_{2A}$ and $T_{2B}$. The secondary rms voltage output of $T_{2A}$ and $T_{2B}$ is approximately 41 -VAC. Diodes $D_6$ and $D_7$ are connected in series with $T_{2A}$ and $T_{2B}$ respectively which produce a pulsating D.C. heater rms voltage of 2-VDC to appear across the electrode of lamp 211 in an alternating fashion that is synchronized with the alternating current appearing across the lamp.

When electrode 213 is the cathode for one half cycle, it is heated which makes it more electron emissive. The anode, electrode 214, is not heated because it is not required to "send" any electrons to the other end of the lamp. Conversely, when the electrode 214 is the cathode for the alternate half cycle, it is heated and the anode, electrode 213, is not. Subsequently, diodes $D_6$ and $D_7$ create a pulsating cathode heater voltage that only appears when needed and in conjunction with the inductance of $T_2$ and capacitance of $C_0$ serve to properly tune the system such that the current waveform, once the lamp is ignited through the action of the $Q_1$, $Q_2$, $Q_3$, $D_1$, $D_2$, $D_3$, $D_4$, and $D_5$ network, also provides efficient pulse ignition and a low lamp arc current crest factor in lamp 211 which improves lamp lumen life, improves lamp mortality, and reduces lamp watt loading.

Figure 7:
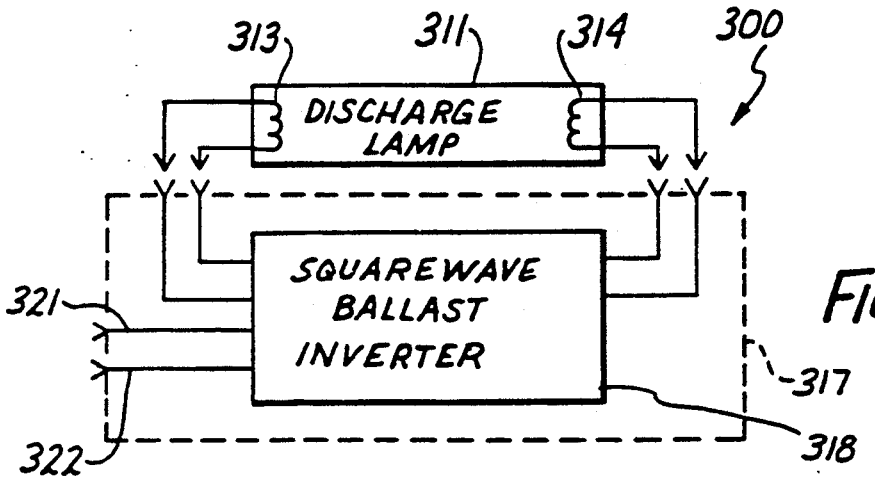
FIG. 7 is a diagrammatic representation of a discharge lamp system constructed according to the invention that includes a squarewave producing ballast.

Considering now FIG. 7, there is shown still another discharge lamp system 300 constructed according to the invention. The system 300 is similar in some respects to the system 10 so that only differences are described in further detail. For convenience, reference numerals designating parts of the system 300 are increased by three hundred over those designating similar parts of the system 10.

Unlike the system 10, the system 300 does not include a module that has been retrofitted to an existing ballast. Instead, it includes a ballast 318 that utilizes known circuit design techniques and components to produce a lamp arc current having a squarewave-type waveform. Thus, the crest factor is well below 1.7, approaching unity. In that regard, the term "squarewave-type" means that the waveform looks something like a squarewave even though it may be somewhat rounded or sloped, and that results in a crest factor that is substantially less than 1.7.

Thus, the invention extends discharge lamp life by slowing electrode deterioration by producing a reduced crest factor that is less than that of existing systems (i.e., less than about 1.7), either with a waveform conditioning module that is retrofitted to an existing ballast or with a ballast that produces a squarewave-type waveform. Discharge lamp life increases to two to three times normal and the time, inconvenience, and cost of lamp maintenance decreases appreciably.

Figure 8:
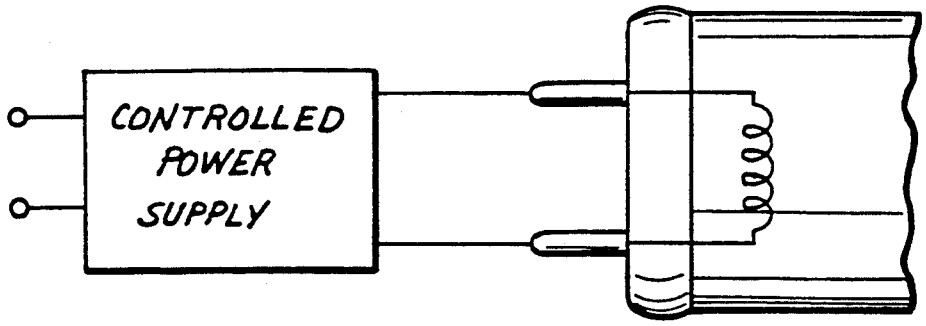
FIG. 8 is a diagrammatic representation of a discharge lamp electrode burn in circuit.

Concerning deterioration of the emissive coating on the electrodes, that is slowed as mentioned above by preheating the electrode before, during, or after fabrication so that the emissive elements are bonded more securely to the electrode before use. That may be done in the case of filament-type electrodes (filaments) by supplying power to the filaments for a period of time with no arc current flowing (i.e., before use), preferably at any voltage that specifically causes the electron emissive material on the lamp electrode to bond more readily to the filaments or electrodes. FIG. 8 is a diagrammatic representation of a discharge lamp electrode burn-in circuit.

The barium, rare earth oxides, and other elements that are typically packed onto the fluorescent lamp electrodes in a powdery form are susceptible to being "blown off" or eroded by lamp ignition and the lamp arc current, particularly during initial use of the lamp. The electrode "burn-in" method fuses the powdery elements to the electrode, making them less susceptible to being eroded by the starting cycle or the lamp arc current and subsequently, improve lamp lumen life and lamp mortality.

Although exemplary embodiments of the invention have been shown and described, many changes, modifications, and substitutions may be made by one having ordinary skill in the art without necessarily departing from the spirit and scope of the invention. For example, one could combine conventional ballast circuitry and waveform conditioning means in what might be called a tuned ballast (instead of having waveform conditioning means added to an existing ballast), and such an arrangement is intended to fall within the scope of the claims.

What is claimed is:

1. A discharge lamp system comprising:

a ballast adapted to be coupled to a discharge lamp for supplying lamp arc current having a predetermined crest factor to the discharge lamp;

a waveform conditioning module coupled to the ballast for causing the lamp arc current to have a crest factor less than the predetermined value; and said waveform conditioning module including an inductor coupled to the ballast between the ballast and a source of electrical power for the ballast and a capacitor coupled to the ballast between the ballast and the lamp.

2. A discharge lamp system comprising:

a ballast including a ballast capacitor, said ballast being adapted to be coupled to a discharge lamp for supplying lamp arc current having a predetermined crest factor to the discharge lamp;

a waveform conditioning module including a capacitor, said waveform conditioning module being coupled to the ballast in series with the ballast capacitor, said waveform conditioning module causing the lamp arc current to have a crest factor less than the predetermined value; and the waveform conditioning module including an inductor.

3. A discharge lamp system comprising:

a ballast including a ballast capacitor, said ballast being adapted to be coupled to a discharge lamp for supplying lamp arc current having a predetermined crest factor to the discharge lamp;

a waveform conditioning module including a capacitor, said waveform conditioning module being coupled to the ballast in series with the ballast capacitor, said waveform conditioning module causing the lamp arc current to have a crest factor less than the predetermined value; and the ballast being adapted to be coupled to a discharge lamp which has first and second electrodes which alternately function as an anode and a cathode and the waveform conditioning module including circuit means for heating each of the first and second electrodes when such electrode is serving as a cathode.

4. A discharge lamp system comprising:

a ballast including a ballast capacitor, said ballast being adapted to be coupled to a discharge lamp for supplying lamp arc current having a predetermined crest factor to the discharge lamp;

a waveform conditioning module including a capacitor, said waveform conditioning module being coupled to the ballast in series with the ballast capacitor, said waveform conditioning module causing the lamp arc current to have a crest factor less than the predetermined value; and first conductive means comprising a first conductor for coupling the ballast to a source of electrical energy and second conductive means for coupling the ballast to the discharge lamp and the waveform conditioning module is coupled to the first conductor between the source and the ballast and to the second conductive means between the ballast and the discharge lamp.

5. A method of extending the life of a discharge lamp wherein the lamp is coupled to a ballast which supplies the lamp with lamp arc current having a crest factor of a predetermined value, said method comprising:

retrofitting the lamp and ballast with a waveform conditioning module by coupling the waveform conditioning module to the ballast to cause the lamp arc current to have a crest factor less than the predetermined value, the step of retrofitting including coupling an inductor to the ballast between the ballast and a source of electrical power for the ballast.

6. A system as described in claim 1 wherein the waveform conditioning module includes a switch coupled across the capacitor and circuit means for operating said switch so tat the time rate of change of current through the inductor and the time rate of change of voltage across the capacitor are harmonically related and synchronized.

7. A system as described in claim 1 wherein the ballast is adapted to be coupled to a discharge lamp which has first and second electrodes which alternately function as an anode and a cathode and the waveform conditioning module includes circuit means for heating each of the first and second electrodes when such electrode is serving as a cathode.

8. A system as described in claim 2 wherein the inductor is coupled to the ballast between the ballast and a source of electrical power for the ballast.

9. A system as described in claim 2 wherein the capacitor of the waveform conditioning module is coupled to the ballast between the ballast and the lamp.

10. A system as described in claim 9 wherein the waveform conditioning module includes a switch coupled across the capacitor of the waveform conditioning module and circuit means for operating said switch so that the time rate of change of current through the inductor and the time rate of change of voltage across the capacitor of the waveform conditioning module are harmonically related and synchronized.

11. A method as defined in claim 5 wherein the step of retrofitting includes coupling a capacitor to the ballast and the lamp between the ballast and the lamp.

* * * * *